US008945029B1

(12) United States Patent
Saling et al.

(10) Patent No.: US 8,945,029 B1
(45) Date of Patent: Feb. 3, 2015

(54) INFANT PATTING SYSTEM

(76) Inventors: Patricia Ann Saling, Safety Harbor, FL (US); John Stephen Tenbarge, Belleair Bluffs, FL (US)

( * ) Notice: Subject to any disclaimer, the term of this patent is extended or adjusted under 35 U.S.C. 154(b) by 315 days.

(21) Appl. No.: 13/199,435

(22) Filed: Aug. 30, 2011

(51) Int. Cl.
*A61H 1/00* (2006.01)
*A61H 23/00* (2006.01)

(52) U.S. Cl.
USPC ..... 601/108; 601/51; 601/57; 601/68; 601/107

(58) Field of Classification Search
USPC ..... 601/108, 46, 49, 51, 56–58, 67–73, 78, 601/107
See application file for complete search history.

(56) References Cited

U.S. PATENT DOCUMENTS 3,138,813 A * 6/1964 Kaplan ..... 15/22.1
4,124,022 A * 11/1978 Gross ..... 600/28
4,198,551 A * 4/1980 Peterson ..... 200/33 R
4,524,250 A * 6/1985 Laviana ..... 200/33 R
4,718,876 A * 1/1988 Lee ..... 446/295
4,858,599 A * 8/1989 Halpern ..... 601/105
4,967,737 A * 11/1990 Bassett et al. ..... 601/35
5,063,912 A * 11/1991 Hughes ..... 601/47
5,158,075 A * 10/1992 Howard ..... 601/79
5,256,098 A * 10/1993 Smith et al. ..... 446/28
5,344,437 A * 9/1994 Pistay ..... 607/109
5,520,616 A * 5/1996 Hofmeister ..... 601/74
5,904,660 A * 5/1999 Kim ..... 601/108
6,968,806 B2 * 11/2005 Helwig ..... 119/28.5
2002/0095103 A1 * 7/2002 Blue ..... 601/46
2007/0055188 A1 * 3/2007 Avni et al. ..... 601/151
2008/0125684 A1 * 5/2008 Nardi et al. ..... 602/5
2008/0306415 A1 * 12/2008 Chan ..... 601/93

* cited by examiner

*Primary Examiner* — Justine Yu
*Assistant Examiner* — Christopher Miller

(57) ABSTRACT

A housing has padded front and rear panels. The panels are coupled along their upper peripheries leaving their lower peripheries unattached constituting an opening. A container is removably positioned within the housing. The container has interior and exterior faces and upper, lower and side faces. A coupling is provided between the lower face and an adjacent lower edge of the interior face. The coupling is pivotable. In this manner the interior face is allowed to pivot. Operational components are provided within the container. The components include a rotatable drive shaft with a plurality of fingers, a motor for rotating the drive shaft and a follower with a ramp shaped face. The follower is adapted to be cyclically contacted by the rotating fingers to pivot the interior face against the front panel. In this manner the system will provide infant patting to the back of a wearer of the system.

4 Claims, 3 Drawing Sheets

FIG 1
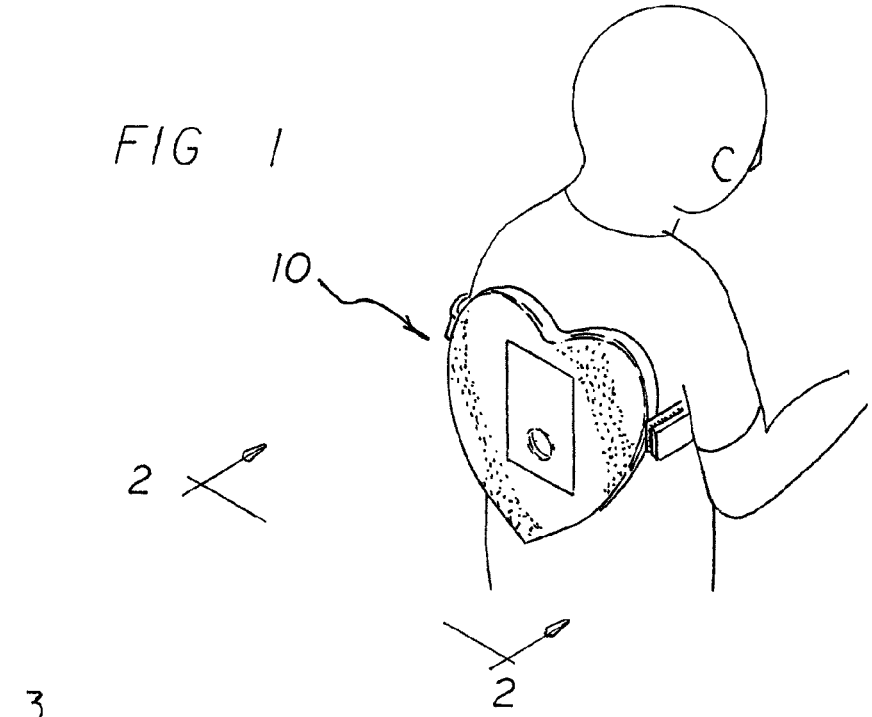
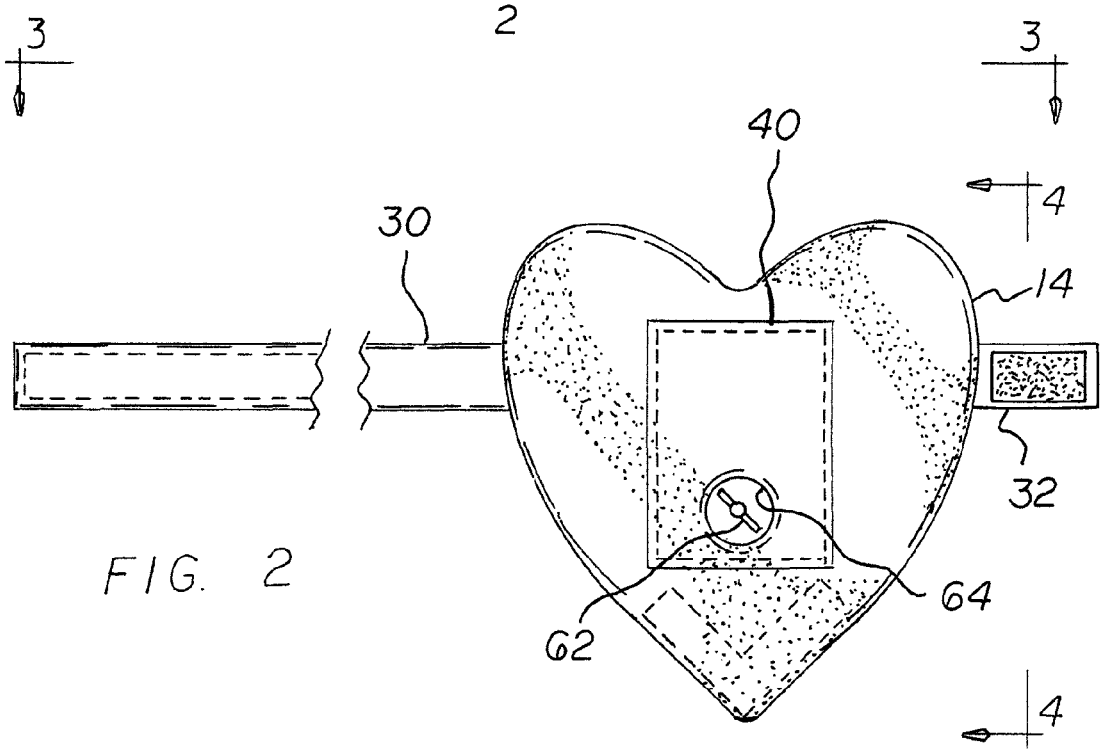
FIG. 2

FIG 3
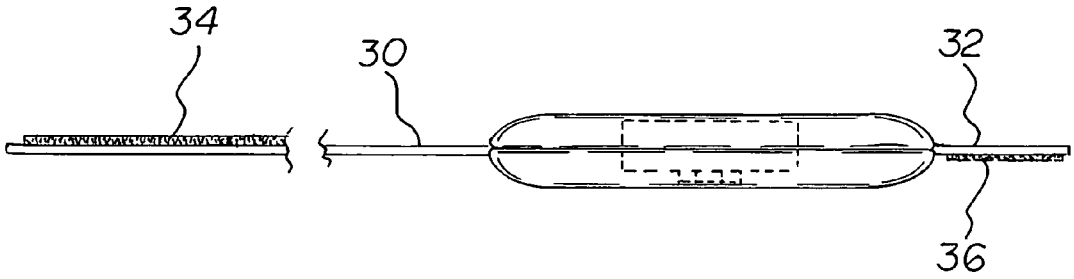
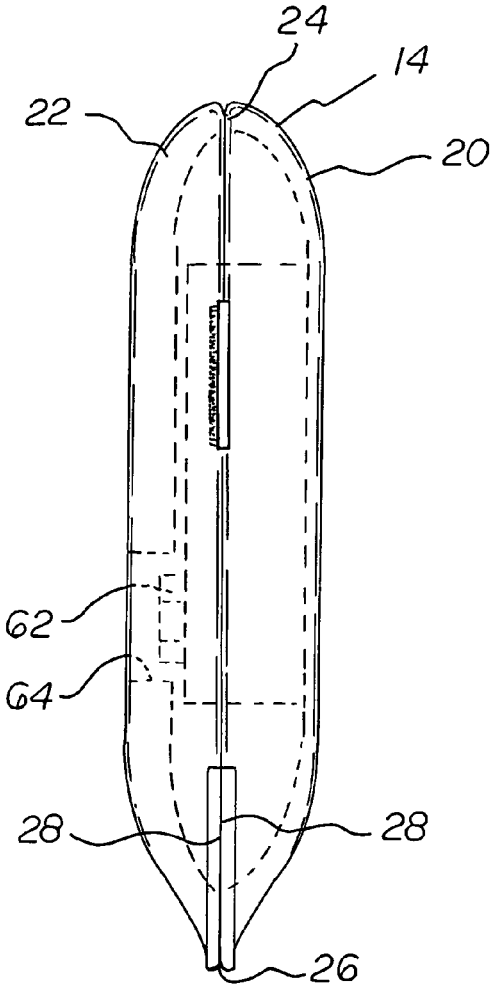
FIG 4

FIG 5
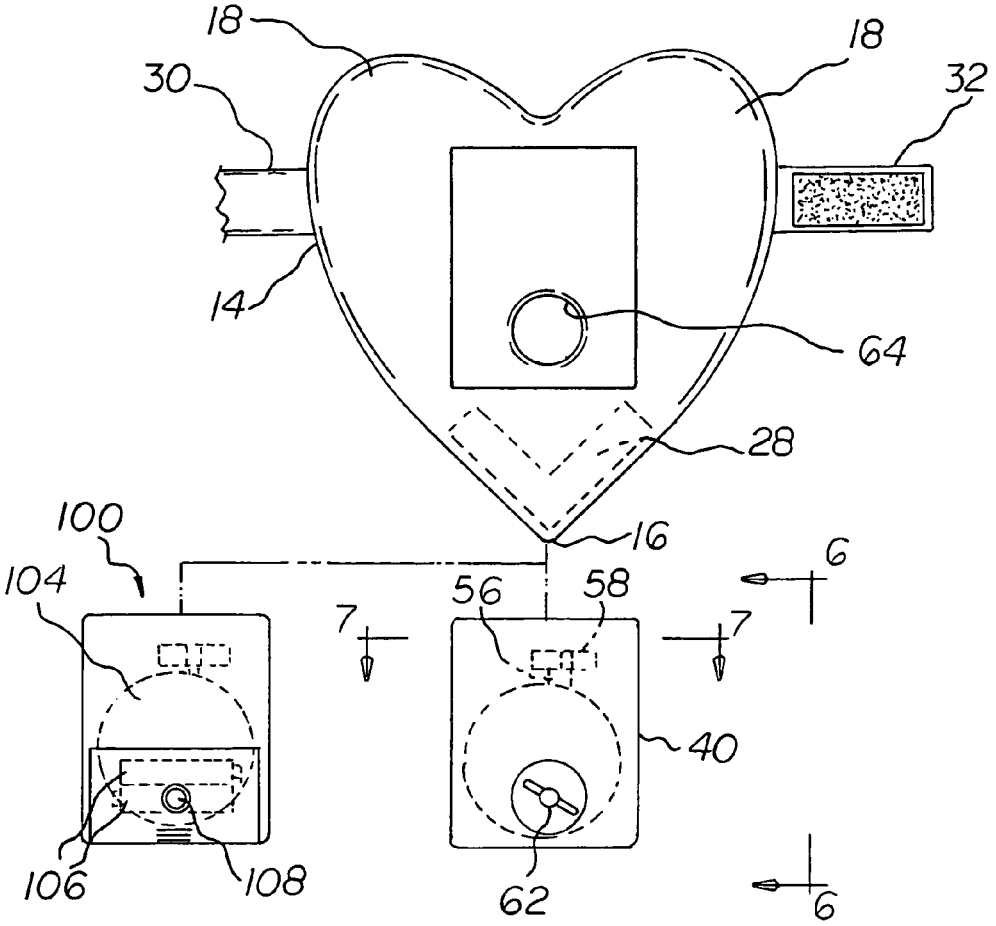
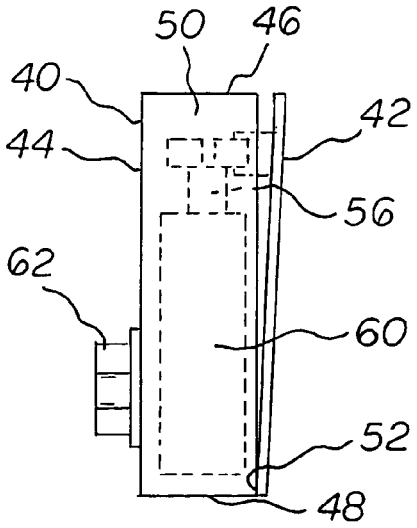
FIG 6
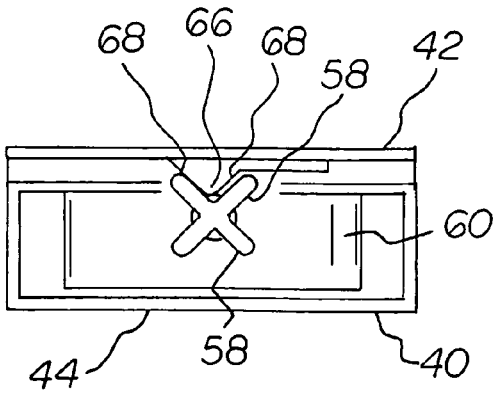
FIG 7

INFANT PATTING SYSTEM

BACKGROUND OF THE INVENTION

1. Field of the Invention

The present invention relates to an infant patting system and more particularly pertains to applying a repeating striking force in a line between a wearer's shoulder blades, the applying force being in a safe, convenient and economical manner.

2. Description of the Prior Art

The use of comforting systems of known designs and configurations is known in the prior art. More specifically, comforting systems of known designs and configurations previously devised and utilized for the purpose of comforting a user through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,538,310 issued Sep. 3, 1985 to Scott relates to an Apparatus for Comforting an Infant. U.S. Pat. No. 6,142,963 issued Nov. 7, 2000 to Black relates to a Vibrating Baby Blanket. Lastly, U.S. Pat. No. 4,951,331 issued Aug. 28, 1990 to Pereria relates to a Crib Mattress Patting Device.

While these devices fulfill their respective, particular objectives and requirements, the aforementioned patents do not describe an infant patting system that allows for applying a repeating striking force in a line between a wearer's shoulder blades, the applying force being in a safe, convenient and economical manner.

In this respect, the infant patting system according to the present invention substantially departs from the conventional concepts and designs of the prior art, and in doing so provides an apparatus primarily developed for the purpose of applying a repeating striking force in a line between a wearer's shoulder blades, the applying force being in a safe, convenient and economical manner.

Therefore, it can be appreciated that there exists a continuing need for a new and improved infant patting system which can be used for applying a repeating striking force in a line between a wearer's shoulder blades, the applying force being in a safe, convenient and economical manner. In this regard, the present invention substantially fulfills this need.

SUMMARY OF THE INVENTION

In view of the foregoing disadvantages inherent in the known types of comforting systems of known designs and configurations now present in the prior art, the present invention provides an improved infant patting system. As such, the general purpose of the present invention, which will be described subsequently in greater detail, is to provide a new and improved infant patting system and method which has all the advantages of the prior art and none of the disadvantages.

To attain this, the present invention essentially comprises an infant patting system. First provided is a housing. The housing is positionable on a wearer's back. The housing is in a heart shaped configuration. The housing has a pointed lowermost portion. The pointed lowermost portion is provided over a lowermost extent of a wearer's backbone. The housing has laterally spaced upper arcuate sections. The upper arcuate sections are provided over a wearer's shoulder blades. The housing has a padded front panel. The housing has a similarly configured padded rear panel. The housing has stitching. The stitching couples the panels along their upper peripheries. In this manner the lower peripheries of the panels are left unattached. The configuration constitutes a V-shaped opening. The housing has a hook and loop fastener. The fastener is adapted to releasably couple. In this manner the opening is closed.

A pair of straps are provided. Each strap has an interior end. The interior end is coupled between the sections above the opening and beneath the arcuate sections. Each strap has an exterior end. The exterior end has a patch of a hook and loop fastener. The fastener is provided on opposing faces of the exterior ends. The straps are adapted to be removably coupled together. In this manner the housing is held to a wearer's back during operation and use.

Provided next is a container. The container is removably positioned within the housing by movement through the opening. The container is in a generally rectilinear configuration. The container has a rectangular interior face. The interior face is provided in contact with the front panel. The container has a parallel rectangular exterior face. The exterior face is provided in contact with the rear panel when the container is within the housing. The container has parallel upper and lower faces. The container has parallel side faces. The side faces are coupled to the exterior face. The container has a coupling.

The coupling is provided between the lower face and an adjacent lower edge of the interior face. The coupling is pivotable. In this manner the interior face is allowed to pivot away from the upper and side faces in response to a force from within the container. Further in this manner the interior face is allowed to resile back parallel with the exterior face when the force is removed.

Provided last are operational components. The operational components are provided within the container. The operational components include a vertically oriented rotatable drive shaft. The drive shaft has an upper end and a lower end. The operational components include a cross shaped driver. The driver has four fingers. The fingers are of the same length. The fingers extend outwardly at 90 degree increments from the upper end. In this manner rotation in a horizontal plane is allowed. The operational components include a motor. The motor receives the lower end, drive shaft and the fingers. The operational components include a wind up dial. The wind up dial has a handle. The handle extends out of the exterior face of the container. The dial is adapted to be rotated. In this manner the motor is powered and the driver is rotated. The rear panel has a circular opening. In this manner access to the dial is. provided. The operational components include a follower. The follower has ramp shaped faces. The ramp shaped faces are provided within the container. The ramp shaped races are fixedly attached to the interior face. The follower is provided at an elevation between the straps. In this manner the follower may be cyclically contacted by the rotating driver. Also in this manner the interior face may be pivoted against the front panel. Further in this manner the system will provide infant patting to the back of a wearer of the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved infant patting system which has all of the advantages of the prior art comforting systems of known designs and configurations and none of the disadvantages.

It is another object of the present invention to provide a new and improved infant patting system which may be easily and efficiently manufactured and marketed.

It is further object of the present invention to provide a new and improved infant patting system which is of durable and reliable constructions.

An even further object of the present invention is to provide a new and improved infant patting system which is susceptible of a low cost of manufacture with regard to both materials and labor, and which accordingly is then susceptible of low prices of sale to the consuming public, thereby making such infant patting system economically available to the buying public.

Even still another object of the present invention is to provide an infant patting system for applying a repeating striking force in a line between a wearer's shoulder blades, the applying force being in a safe, convenient and economical manner.

Lastly, it is an object of the present invention to provide a new and improved infant patting system. A housing has padded front and rear panels. The panels are coupled along their upper peripheries leaving their lower peripheries unattached and constituting an opening. A container is removably positioned within the housing. The container has interior and exterior faces and upper, lower and side faces. A Coupling is provided between the lower face and an adjacent lower edge of the interior face. The coupling is pivotable. In this manner the interior face is allowed to pivot. Operational components are provided within the container. The components include a rotatable drive shaft with a plurality of fingers, a motor for rotating the drive shaft and a follower with a ramp shaped face. The follower is adapted to be cyclically contacted by the rotating fingers to pivot the interior face against the front panel. In this manner the system will provide infant patting to the back of a wearer of the system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of an infant patting system constructed in accordance with the principles of the present invention.

FIG. 2 is a rear elevational view of the system taken along line 2-2 of FIG. 1.

FIG. 3 is a plan view of the system taken along line 3-3 of FIG. 2.

FIG. 4 is a side elevational view of the system taken along line 4-4 of FIG. 2.

FIG. 5 is an exploded rear elevational view of the system illustrating a primary and secondary embodiment.

FIG. 6 is a side elevational view of the system taken-along line 6-6 of FIG. 5.

FIG. 7 is a plan view of the system taken along line 7-7 of FIG. 5.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved infant patting system embodying the principles and concepts of the present invention and generally designated by the reference numeral 10 will be described.

The present invention, the infant patting system 10 is comprised of a plurality of components. Such components in their broadest context include a housing, a container and operational components. Such components are individually configured and correlated with respect to each other so as to attain the desired objective.

First provided is a housing 14. The housing is positionable on a wearer's back. The housing, in the preferred embodiment as illustrated, is in a heart shaped configuration. The housing has a pointed lowermost portion 16. The pointed lowermost portion is provided over a lowermost extent of a wearer's backbone. The housing has laterally spaced upper arcuate sections 18. The upper arcuate sections are provided over a wearer's shoulder blades. The housing has a padded front panel 20. The housing has a similarly configured padded rear panel 22. The housing has stitching 24. The stitching couples the panels along their upper peripheries. In this manner the lower peripheries of the panels are left unattached. The configuration constitutes a V-shaped opening 26. The housing has a hook and loop fastener 28. The fastener is adapted to releasably couple. In this manner the opening is closed.

A pair of straps 30, 32 are provided. Each strap has an interior end. The interior end is coupled between the sections above the opening and beneath the arcuate sections. Each strap has an exterior end. The exterior end has a patch of a hook and loop fastener 34, 36. The fastener is provided on opposing faces of the exterior ends. The straps are adapted to be removably coupled together. In this manner the housing is held to a wearer's back during operation and use.

Provided next is a container 40. The container is removably positioned within the housing by movement through the opening. The container is in a generally rectilinear configuration. The container has a rectangular interior face 42. The interior face is provided in contact with the front panel. The container has a parallel rectangular exterior face 44. The exterior face is provided in contact with the rear panel when the container is. within the housing. The container has parallel upper and lower faces 46, 48. The container has parallel side faces 50. The side faces are coupled to the exterior face. The container has a coupling 52. The coupling is provided between the lower face and an adjacent lower edge of the interior face. The coupling is pivotable. In this manner the interior face is allowed to pivot away from the upper and side faces in response to a force from within the container. Further in this manner the interior face is allowed to resile back parallel with the exterior face when the force is removed.

Provided last are operational components. The operational components are provided within the container. The operational components include a vertically oriented rotatable drive shaft 56. The drive shaft has an upper end and a lower end. The operational components include a cross shaped driver. The driver has four fingers 58. The fingers are of the same length. The fingers extend outwardly at 90 degree increments from the upper end. In this manner rotation in a horizontal plane is allowed. The operational components include a motor 60. The motor receives the lower end, drive shaft and the fingers. The operational components include a wind up dial. The wind up dial has a handle 62. The handle extends out of the exterior face of the container. The dial is adapted to be rotated. In this manner the motor is powered and the driver is rotated. The rear panel has a circular opening 64. In this manner access to the dial is provided. In the preferred embodiment, the back panel has a centrally located, rectangular, unpadded section in which the circular opening is formed.

The operational components include a follower 66. The follower has ramp shaped faces 68. The ramp shaped faces are provided within the container. The ramp shaped races are fixedly attached to the interior face. The follower is provided at an elevation between the straps. In this manner the follower may be cyclically contacted by the rotating driver. Also in this manner the interior face may be pivoted against the front panel. Further in this manner the system will provide infant patting to the back of a wearer of the system.

An alternate embodiment 100 of the present invention is provided. A motor 104 is provided. The motor is an electric motor. The motor has batteries 106. The motor also has a switch 108. The remainder of the components of the alternate embodiment are as in the primary embodiment as described above.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An infant patting system comprising:

a housing fabricated of padded front and rear panels, the panels being coupled along their upper peripheries leaving their lower peripheries unattached and constituting an opening;

a container removably positioned within the housing with interior and exterior faces and with upper and lower and side faces, a coupling between the lower face and an adjacent lower edge of the interior face, the coupling being pivotable for allowing the interior face to pivot; and operational components within the container including a rotatable drive shaft with a plurality of fingers, a motor for rotating the drive shaft, a follower with a ramp shaped face attached to the interior face, the follower adapted to be cyclically contacted by the rotating fingers to pivot the interior face against the front panel whereby the system is configured to provide infant patting to the back of a wearer of the system.

2. The system as set forth in claim 1 wherein the motor is a spring motor with a dial, the spring motor being powered by rotating the dial.

3. The system as set forth in claim 1 wherein the motor is an electric motor with batteries and a switch.

4. An infant patting system for applying a repeating striking force in a line between a wearer's shoulder blades, the system comprising, in combination:

a housing positionable on a wearer's back, the housing being in a heart shaped configuration with a pointed lowermost portion configured to overlay a lowermost extent of a wearer's backbone and with laterally spaced upper arcuate sections configured to overlay a wearer's shoulder blades, the housing being fabricated of a padded front panel and a similarly configured padded rear panel, stitching coupling the panels along their upper peripheries leaving the lower peripheries of the panels unattached and constituting a V-shaped opening, a hook and loop fastener adapted to releasably couple to close the opening;

a pair of straps, each strap having an interior end coupled between the sections above the opening and beneath the arcuate sections, each strap having an exterior end with a patch of a hook and loop fastener on opposing faces of the exterior ends, the straps adapted to be removably coupled together for holding the housing to a wearer's back during operation and use;

a container removably positioned within the housing by movement through the opening, the container being in a generally rectilinear configuration with a rectangular interior face positioned in contact with the front panel and a parallel rectangular exterior face positioned in contact with the rear panel when the container is within the housing, the container having parallel upper and lower faces and parallel side faces coupled to the exterior face, a coupling between the lower face and an adjacent lower edge of the interior face, the coupling being pivotable for allowing the interior face to pivot away from the upper and side faces in response to a force from within the container and then to resile back parallel with the exterior face when the force is removed; and operational components within the container including a vertically oriented rotatable drive shaft with an upper end and a lower end, a cross shaped driver with four fingers of the same length extending outwardly at 90 degree increments from the upper end for rotation in a horizontal plane, a motor receiving the lower end for driving the drive shaft and the fingers, a wind up dial with a handle extending out of the exterior face of the container, the dial adapted to be rotated for powering the motor and rotating the driver, a circular opening in the rear panel for providing access to the dial, a follower with ramp shaped faces within the container and fixedly attached to the interior face, the follower being at an elevation between the straps for being cyclically contacted by the rotating driver to pivot the interior face against the front panel whereby the system is configured to provide infant patting to the back of a wearer of the system.

* * * * *